United States Patent [19]

Okane et al.

[11] Patent Number: 4,565,551

[45] Date of Patent: Jan. 21, 1986

[54] COAL GASIFICATION APPARATUS

[75] Inventors: Koji Okane, Ibaraki; Hidemasa Nakajima, Ibaraki; Shozo Okamura, Ibaraki; Masanobu Sueyasu, Kawachinagano; Takashi Manago, Ibaraki, all of Japan

[73] Assignee: Sumitomo Metal Industries, Ltd., Osaka, Japan

[21] Appl. No.: 543,131

[22] Filed: Oct. 18, 1983

[51] Int. Cl.[4] ..... C10J 3/48; C10J 3/50

[52] U.S. Cl. ..... 48/92; 266/225; 266/226

[58] Field of Search ..... 48/92; 75/59; 266/225, 266/226; 239/427.5

[56] References Cited

U.S. PATENT DOCUMENTS 2,923,260 2/1960 Rummel ..... 48/92

4,353,712 10/1982 Marion et al. ..... 48/DIG. 7

4,388,084 6/1983 Okane et al. ..... 48/92

4,459,137 7/1984 Tonoue et al. ..... 48/92

FOREIGN PATENT DOCUMENTS 543003 10/1927 Fed. Rep. of Germany ... 239/427.5

*Primary Examiner*—Peter Kratz

*Attorney, Agent, or Firm*—Burns, Doane, Swecker and Mathis

[57] ABSTRACT

A method and apparatus for gasifying a solid carbonaceous material such as coal is disclosed in which powdery coal is top-blown together with oxygen gas and steam onto a molten metal bath through a non-immersing multihole lance, said powdery coal is blown separately from the oxygen gas and steam, and the steam is commingled with the oxygen gas within the lance before they are injected out of the lance.

3 Claims, 4 Drawing Figures

COAL GASIFICATION APPARATUS

BACKGROUND OF THE INVENTION

This invention relates to a method of carrying out the gasification of solid carbonaceous materials such as coal, coke or the like (sometimes referred to as "coal" collectively hereunder) by blowing coal and oxygen together with a supplementary gasifying agent such as steam or carbon dioxide gas onto a high temperature molten metal bath.

In particular, this invention relates to the gasification method defined above, which can achieve improvements in thermal efficiency during gasification, and which can also achieve precise control of the temperature of a molten metal bath and a prolonged service life of the lance used in blowing oxygen and coal.

Generally speaking, so-called coal gasification using a molten metal bath in a gasification furnace is a method wherein the heat necessary for the gasification is supplied from the molten metal. The gasification of coal is effected through reactions between carbon in the molten metal and oxygen gas. The carbon in the molten metal is derived from the coal which is supplied.

The basic idea of coal gasification using a molten metal bath is schematically shown in FIG. 1. A melting furnace, i.e. gasification furnace 1, contains a substantial amount of molten metal, usually molten iron 2. Through a non-immersing lance 3, coal 5, oxygen 6, and a supplementary gasifying agent 7 such as steam, carbon dioxide gas, and mixtures thereof are top-blown onto the molten metal to effect the gasification of coal. See copending U.S. Ser. No. 404,332, now U.S. Pat. No. 4,459,137, and U.S. Pat. Nos. 4,388,084 and 4,389,246. The non-immersing lance may be replaced by an immersing lance or bottom-blowing nozzle (not shown in FIG. 1). See U.S. Pat. Nos. 3,526,478 and 3,533,739, which disclose a gasification furnace provided with a bottom-blowing nozzle. The slag formed on the surface of the molten metal is indicated by reference number 4. The supplementary agent 7 such as steam or carbon dioxide gas serves as a cooling agent to control the temperature of the molten metal bath while coal gasification is being carried out. In case steam or carbon dioxide gas is used, it serves as an additional oxygen source, too. Such a cooling agent is effective for promoting a water gas reaction with carbon in the molten metal or a carbon solution reaction.

It is conventional in the gasification of coal to supply the supplementary gasifying agent separately from the primary gasification agent (i.e., oxygen gas), blowing it through a non-immersing lance, immersed lance, or bottom-blowing nozzle.

In case a non-immersing lance is used, although a prolonged service life of the lance can be attained, the supplementary agent such as steam reacts with CO in the atmosphere before it reacts with carbon in the molten metal on the surface of the bath. ($CO+H_2O \rightarrow CO_2+H_2$).

Alternatively, if a sharpened local cooling is caused by the supplementary agent, the reaction temperature is lowered, resulting in a decrease in the rate of the water gas formation or carbon solution reaction. This means that the supplementary agent, which is also a cooling agent, does not exert its cooling effect to a sufficient degree, nor does it serve as an effective supplementary agent, resulting in less improvement in thermal efficiency during gasification even if such a cooling agent is added.

On the other hand, a method using an immersed lance or bottom-blowing nozzle can improve the rate of a water gas reaction with carbon in the molten metal and it also increases the reaction rate of carbon solution, resulting in an increase in the thermal efficiency. However, such a method is not practical, since the damage of lances or nozzles due to the hot molten metal is marked, making a continuous long-lasting gasification operation impossible.

In a method of coal gasification using a molten metal bath, it is necessary that the supplementary gasifying agent (i.e., the cooling agent) be dissolved and diffused into a molten metal bath in an efficient manner so as to increase the chances of the cooling agent contacting carbon in the molten metal. It is also necessary to place the lance as far as possible from the molten metal bath so as to prolong its service life.

However, in the conventional method, a plurality of lances for coal, oxygen gas and the supplementary agent, respectively, are used, or a multihole lance having a plurality of injection nozzles for coal, oxygen gas, and the supplementary gas, respectively, is used. The oxygen gas and supplementary gas are separately blown onto the molten metal bath, resulting in less efficient dissolving of the supplementary agent in the bath.

SUMMARY OF THE INVENTION

The object of this invention is to eliminate prior art disadvantages such as those mentioned above.

The primary gasifying agent, i.e. oxygen gas, is blown onto the molten metal bath at a speed of Mach Number 1–3, and the oxygen gas thus injected forms a high temperature hot spot on the surface of the molten metal bath. The inventors of this invention found that when the supplementary agent is carried on an oxygen jet, it can be injected deep into the molten metal bath, where the temperature of the bath is much higher than on the surface of the bath. The agent thus injected deep into the molten metal bath can easily and efficiently be dissolved thereinto.

On the basis of the findings mentioned above, the inventors of this invention accomplished this invention.

Thus, this invention resides in a method for gasifying a solid carbonaceous material by top-blowing a finely divided carbonaceous material together with oxygen gas and a supplementary gasifying agent onto a molten metal bath through a non-immersing multihole lance, characterized in that said solid carbonacenous material is blown onto the molten metal bath separately from the oxygen gas and the supplementary agent, and that the supplementary agent is commingled with the oxygen gas within the lance before they are injected out of the lance.

For the purpose of this invention, a lance is used in which a passageway for the supplementary gasifying agent is combined with a passageway for oxygen gas before they reach the injecting end of the lance. The point where two such passageways are combined will be called a "junction point" hereunder.

This invention also resides in an apparatus for the gasification of a solid carbonaceous material, which comprises, in combination, a gasification furnace maintaining a molten metal bath and a non-immersing multihole lance through which a finely divided solid carbonaceous material, oxygen gas, and a supplementary gasifying agent are blown onto the molten metal bath, said lance having a main injection nozzle communicated with a main passageway for the solid carbonaceous material, said main injection nozzle being surrounded by a plurality of subsidiary injection nozzles communicated with subsidiary passageways for oxygen gas and the supplementary agent, the end of each passageway for said supplementary gasifying agent being combined with a corresponding passageway for oxygen gas before the passageway for oxygen gas reaches the injecting end of the subsidiary nozzle.

Thus, according to this invention, the supplementary gasifying agent is added to oxygen gas before it is injected from the lance so that a sufficient level of dissolution and diffusion of the supplementary agent into the molten metal bath as well as a prolonged service life of the lance can be attained simultaneously.

Furthermore, according to this invention, since the supplementary agent is added to a jet stream of oxygen gas, the atomization of the supplementary agent is accelerated and the thus atomized supplementary agent easily reaches the hot spot which is formed due to an oxygen jet, resulting in an efficient dissolution and diffusion of the agent into the molten metal bath. This also promotes the reaction with carbon in the metal bath. In addition, the lance employed in this invention is of the non-immersing type.

Therefore, according to this invention, a continuous operation for coal gasification is made practical.

In a preferred embodiment, this invention employs a lance which has a main nozzle for injecting powdery coal and a plurality of subsidiary nozzles, usually three in number, for injecting a jet stream of oxygen carrying the supplementary agent (i.e., steam, $CO_2$, hydrocarbon gases, or a mixture thereof). The subsidiary nozzles are symmetrically provided surrounding the main nozzle. The junction point is located far enough from the injecting end of the nozzles to thoroughly commingle the agent with the oxygen gas before the two are injected from the lance.

DETAILED DESCRIPTION OF THE PREFERRED EMBODIMENTS

Figure 2:
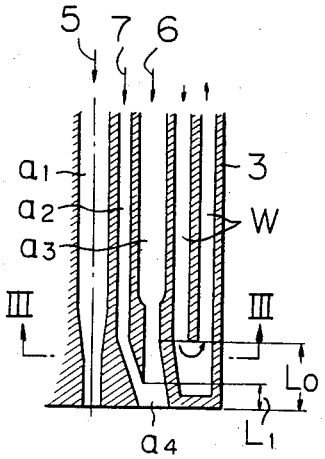
FIG. 2 is a cross-sectional view of a lance employed in this invention.
Figure 3:
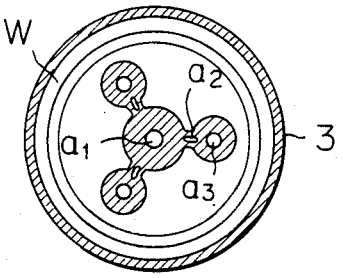
FIG. 3 is a cross-sectional view taken along the line III—III of FIG. 2.
Figure 4:
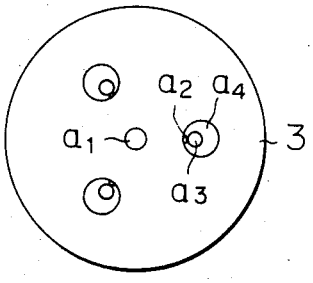
FIG. 4 is an end view of the lance shown in FIG. 2 and 3.

An example of a non-immersing lance is schematically shown in FIGS. 2 through 4. As shown therein, the main passageway $a_1$ and subsidiary passageways $a_2$, $a_3$ are arranged with the subsidiary passageways surrounding the main passageway $a_1$. The exit of the subsidiary passageway for a supplementary gasifying agent is combined with a passageway for oxygen gas. A passageway for cooling water (W) is also provided.

Thus, according to this invention, through the passageway, i.e. hole $a_1$, coal powder is supplied, through hole $a_2$ steam is supplied and through hole $a_3$ oxygen gas is supplied. A stream of the supplementary agent is combined with the oxygen gas stream at the junction point near the exit end of the lance and they are then blown onto the molten metal bath. As mentioned previously, the junction point is located far enough to thoroughly commingle the supplementary agent with the oxygen. It is preferable that the junction point is located at a distance $L_1$ from the exit end of the nozzle (see FIG. 2), which is shorter than half the distance from the starting point of the tapered inner wall of the passageway for the oxygen gas to the exit end of the nozzle ($L_0$), namely, $L_1 < L_0 \times \frac{1}{2}$. When the distance $L_1$ is longer than half the distance $L_0$, the jet stream of the oxygen gas is sometimes disturbed.

Since according to this invention a supplementary gasifying agent is added to a jet of oxygen gas and is dispersed throughout the stream of the oxygen jet before injection, the supplementary agent thus entrained by the jet of oxygen gas efficiently reaches the hot spot formed in the molten metal bath. Therefore, the supplementary gasifying agent is efficiently dissolved into the molten metal and is diffused thoroughly. As a result, the agent effectively serves as a cooling agent to precisely control the temperature of the molten metal bath, resulting in a remarkable increase in thermal efficiency during gasification.

The supplementary gasifying agent may be any one which is endothermic when added to a high temperature molten metal. For the purpose of this invention, steam, carbon dioxide gas, and mixtures thereof may be employed advantageously as a supplementary gasifying agent. Of these, steam is preferred.

The finely divided carbonaceous material, e.g. powdery coal may be injected while being carried in a pressurized air as a carier gas.

In a preferred embodiment, this invention employs a multihole lance such as the one shown in FIGS. 2–4. Take, for example, a gasification furnace with which powdery coal can be processed at a rate of 1–2.7 tons/hour while being carried in pressurized air as a carrier gas at a flow rate of 50–220 $Nm^3$/hour. Oxygen gas is introduced at a rate of 900–2200 $Nm^3$/hour, and steam at 100–500 kg/hour. When a gasification furnace with an increased processing capacity is used, the volumes of the oxygen gas and the supplementary agent to be blown through the lance may proportionately be increased. A plurality of lances may be used for this purpose.

This invention will be described in conjunction with some examples of this invention, which are presented merely for illustrative purposes and it should be understood that they do not restrict this invention in any way.

EXAMPLES

Figure 1:
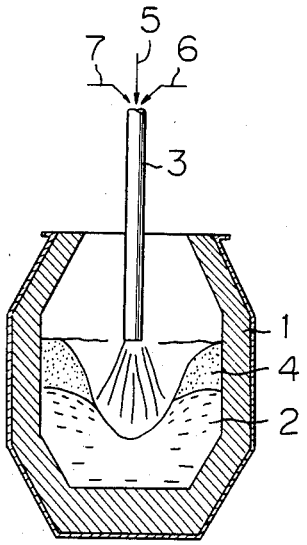
FIG. 1 is a schematic cross-sectional illustration of a gasification furnace.

A series of experiments were carried out using a 15-ton melting furnace similar to that shown in FIG. 1.

Coal gasification was achieved by blowing coal together with oxygen gas and steam as a supplementary gasifying agent onto a molten iron bath maintained within the furnace. The lance used was similar to that shown in FIGS. 2–4.

The molten iron bath contained 0.5–3% carbon and the temperature thereof was 1400°–1600° C. The coal to be blown onto the molten metal was finely divided such that 80% of the coal was −200 mesh. This finely divided powdery coal was blown through a hole $a_1$ of the lance onto the molten metal at a rate of 2.5 tons/hour, which is the processing capacity of the gasification furnace used. Pressurized air was used as a carrier gas for the powdery coal.

The oxygen gas was supplied through a hole $a_3$ at a rate of 8 kg/$cm^2$A, i.e. 1540 $Nm^3$/hour. The supplementary gasifying agent, in this case steam, was blown through a hole $a_2$ at a rate of 6 kg/cm$^2$A, i.e. 200 kg/hour. The stream of steam was combined with the jet of oxygen gas before the steam was blown out of the lance through a hole $a_4$, i.e. the steam was added to the oxygen gas within the lance. For the purpose of preventing the condensation of steam within the lance, it is desirable to overheat the steam to a temperature 100°-200° C. higher than the saturation point thereof.

TABLE 1

| Analysis of Coal | | | | | | | | |
|---|---|---|---|---|---|---|---|---|
| Technical Analysis (% by weight) | | | | Elemental Analysis (d.a.f.) (% by weight) | | | | |
| F.C | V.M | Ash | Mo | C | H | O | N | S |
| 55.4 | 34.4 | 8.0 | 2.2 | 84.3 | 5.2 | 7.9 | 1.8 | 0.8 |

TABLE 2

| Results of Operation | | | | | | | | |
|---|---|---|---|---|---|---|---|---|
| | Gas composition (% by volume) | | | | Heat Content | Volume of Gas | Thermal Efficiency | Service Life of Lance |
| | CO | $CO_2$ | $H_2$ | Others | (Kcal/Nm$^3$) | (Nm$^3$/Hr) | (%)* | (Hr) |
| This invention | 62-64 | 3-6 | 27-30 | 4-5 | 2630 | 2125 | 79.0 | 4000 |
| Comparative Example 1 | 55-59 | 6-8 | 28-30 | 4-5 | 2470 | 2025 | 70.0 | 4000 |
| Comparative Example 2 | 62-64 | 3-6 | 27-30 | 4-5 | 2630 | 2125 | 79.0 | 500 (Immersed lance) |

NOTE: * $\frac{\text{Total Sensible Heat of Product Gas (Calorie)}}{\text{Total Heat of Input Coal (Calorie)}} \times 100$ The analysis of the coal used in these examples is shown in Table 1 below. The results of the experiments are summarized in Table 2.

For comparative purposes, the results obtained by using the conventional non-immersing multihole lance and immersed lance are shown in Comparative Examples 1 and 2. The conventional non-immersing lance used in Comparative Example 1 is similar to that shown in FIG. 2 of U.S. Pat. No. 4,388,084. The immersed lance was protected by coating the outer surface thereof with a castable refractory material. In Comparative Example 1 using the conventional non-immersing lance, the stream of the supplementary gasifying agent was not combined with a jet stream of oxygen before being injected from the lance. In Comparative Example 2, powdery coal and oxygen gas were supplied through a non-immersing lance and steam was supplied to the molten metal bath through the immersed lance mentioned above. Since it is advantageous to introduce steam through an immersed lance in view of its reactivity towards carbon in the molten iron, this comparative example is a control example with respect to the thermal efficiency of coal gasification, though, needless to say, the service life of the lance is not satisfactory.

As is apparent from the data shown in Table 2, coal gasification according to this invention can produce a product gas with a large heat content and at the same time achieve a high thermal efficiency due to the addition of the supplementary gasifying agent as a cooling agent. In particular, the thermal efficiency is the same as for an immersed lance (see Comparative Example 2). Furthermore, since the lance is of the non-immersing type, it was free from severe damage during gasification, and could therefore exhibit a prolonged service life. The data regarding heat content, gas volume, thermal efficiency, and service life in Table 2 are average values.

Although the invention has been described with preferred embodiments, it is to be understood that variations and modifications may be employed without departing from the concept of this invention as defined in the following claims.

What is claimed is:

1. An apparatus for the gasification of a solid carbonaceous material, which comprises, in combination, a gasification furnace containing a molten metal bath and a non-immersing multihole lance connected to said furnance and passing through a top opening therein through which lance a finely divided solid carbonaceous material, oxygen gas, and a supplementary gasifying agent are blown onto the molten metal bath, said lance having a main injection nozzle with an injection end opening at the face of said lance and communicated with a main passageway for the solid carbonaceous material, said main injection nozzle with an injection end opening at the face of said lance being surrounded by a plurality of subsidiary injection nozzles, each of said subsidiary injection nozzles having injection ends at the face of the lance and being, communicated with subsidiary passageways for oxygen gas and the supplementary agent, the end of each passageway for said supplementary gasifying agent communicating with a corresponding separate passageway for oxygen gas at a location above an injecting end of corresponding subsidiary nozzle.

2. The apparatus defined in claim 1, in which said solid carbonaceous material is coal, said supplementary agent is steam, the coal is blown through the main passageway provided at the center of the lance, and a plurality of subsidiary passageways for oxygen gas and steam are provided surrounding the main passageway.

3. The apparatus defined in claim 1, in which three subsidiary nozzles are symmetrically provided with respect to the main nozzle.

* * * * *